US010987915B2

(12) United States Patent
McCarthy

(10) Patent No.: US 10,987,915 B2
(45) Date of Patent: Apr. 27, 2021

(54) REGISTRATION SYSTEM WITH A SPLINE AND YOKE

(71) Applicant: Xerox Corporation, Norwalk, CT (US)

(72) Inventor: Jacob R. McCarthy, Williamson, NY (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 16/380,160

(22) Filed: Apr. 10, 2019

(65) Prior Publication Data

US 2020/0324540 A1 Oct. 15, 2020

(51) Int. Cl.
*B41F 13/12* (2006.01)
*B41F 33/14* (2006.01)
*B41F 33/16* (2006.01)

(52) U.S. Cl.
CPC ..... *B41F 13/12* (2013.01); *B41F 33/14* (2013.01); *B41F 33/16* (2013.01)

(58) Field of Classification Search
None
See application file for complete search history.

(56) References Cited

U.S. PATENT DOCUMENTS 6,485,140 B1 * 11/2002 Lidke ..... B41J 11/001 347/102
2007/0280763 A1 * 12/2007 Suzuki ..... B65H 9/006 399/394

* cited by examiner

*Primary Examiner* — Erica S Lin

(57) ABSTRACT

A registration system for a printing device and a method for controlling the same are disclosed. For example, the registration system includes a lead screw motor, a lead screw coupled to the lead screw motor, and a carriage coupled to the lead screw. The carriage includes two drive rollers, wherein each drive roller is coupled to a respective splined shaft coupled to a respective yoke, wherein the respective yoke is coupled to a drive pulley and a drive motor that is in a fixed position, wherein movement of the carriage causes the respective splined shaft of the two drive rollers to move guided by the respective yoke.

12 Claims, 6 Drawing Sheets

REGISTRATION SYSTEM WITH A SPLINE AND YOKE

The present disclosure relates generally to printing devices and, more particularly, to a registration system of a printing device with a spline and yoke.

BACKGROUND

Printing devices can be used to print images on print media. The print media can be fed through the printing device along a transport path and imaging path to have the image printed. Along the transport path and the imaging path, there are certain locations where processing errors can occur that can cause a misalignment of the image relative to the print media.

For example, the print device can have a registration system. The registration system may be responsible for correctly feeding the print media to an imaging system such that the printed image is correctly aligned with the print media. Some registration systems use a carriage that moves drive rollers and motors of the drive rollers which can have a large amount of total weight. The large amount of weight attached to the carriage can cause inefficiencies due to high amounts of inertia and increased wear.

For example, the high amounts of inertia may cause a hysteresis when the carriage is started or stopped. As a result, the speed of the carriage is slowly increased and decreased as the carriage moves to a desired location. In addition several small adjustments may be made as the carriage over shoots or under shoots the desired location due to the high amount of inertia.

SUMMARY

According to aspects illustrated herein, there are provided a registration system for a printing device and a method for controlling the same. One disclosed feature of the embodiments is a registration system for a printing device comprising a lead screw motor, a lead screw coupled to the lead screw motor, and a carriage coupled to the lead screw. The carriage includes two drive rollers, wherein each drive roller is coupled to a respective splined shaft coupled to a respective yoke, wherein the respective yoke is coupled to a drive pulley and a drive motor that is in a fixed position, wherein movement of the carriage causes the respective splined shaft of the two drive rollers to move guided by the respective yoke.

Another disclosed feature of the embodiments is a method for controlling a position of a print media in a registration system. In one embodiment, the method detects a position of a print media via at least one sensor, determines a desired movement of a carriage that moves drive rollers, wherein each drive roller is coupled to a splined shaft and a yoke, wherein the splined shaft moves laterally inside of the yoke and a desired rotational speed of the drive rollers, and moves the carriage and rotating the drive rollers in accordance with the desired movement to adjust the position of the print media in the registration system of a printing device.

BRIEF DESCRIPTION OF THE DRAWINGS

The teaching of the present disclosure can be readily understood by considering the following detailed description in conjunction with the accompanying drawings, in which.

To facilitate understanding, identical reference numerals have been used, where possible, to designate identical elements that are common to the figures.

DETAILED DESCRIPTION

The present disclosure is related to a registration system of a printing device with a spline and yoke and a method for registering a print media using the registration system of the present disclosure. As discussed above, a printing device can have a registration system. The registration system may be responsible for correctly feeding the print media to an imaging system such that the printed image is correctly aligned with the print media. Some registration systems use a carriage that moves drive rollers and motors of the drive rollers which can have a large amount of total weight. The large amount of weight attached to the carriage can cause inefficiencies due to high amounts of inertia and increased wear.

For example, the high amounts of inertia may cause a hysteresis when the carriage is started or stopped. As a result, the speed of the carriage is slowly increased and decreased as the carriage moves to a desired location. In addition several small adjustments may be made as the carriage over shoots or under shoots the desired location due to the high amount of inertia.

Embodiments of the present disclosure provide a registration system that uses a spline and yoke that allows the motors of the drive roller to be in a fixed position. As a result, the amount of weight that is moved by the carriage is greatly reduced and the lateral movement (e.g., inboard and outboard) of the carriage may be greatly improved. For example, the reduced weight may decrease the inertia and hysteresis upon starting and stopping the carriage. Thus, the skew and lateral position of the print media fed through the registration system of the present disclosure may be corrected more quickly and efficiently.

In addition, the reduced weight on the carriage may reduce the amount of wear on the lead screw and lead screw motor. As a result, maintenance costs can also be reduced as the lead screw may be replaced less frequently and the lead screw motor may operate for a longer time period due to a lower load.

Figure 1:
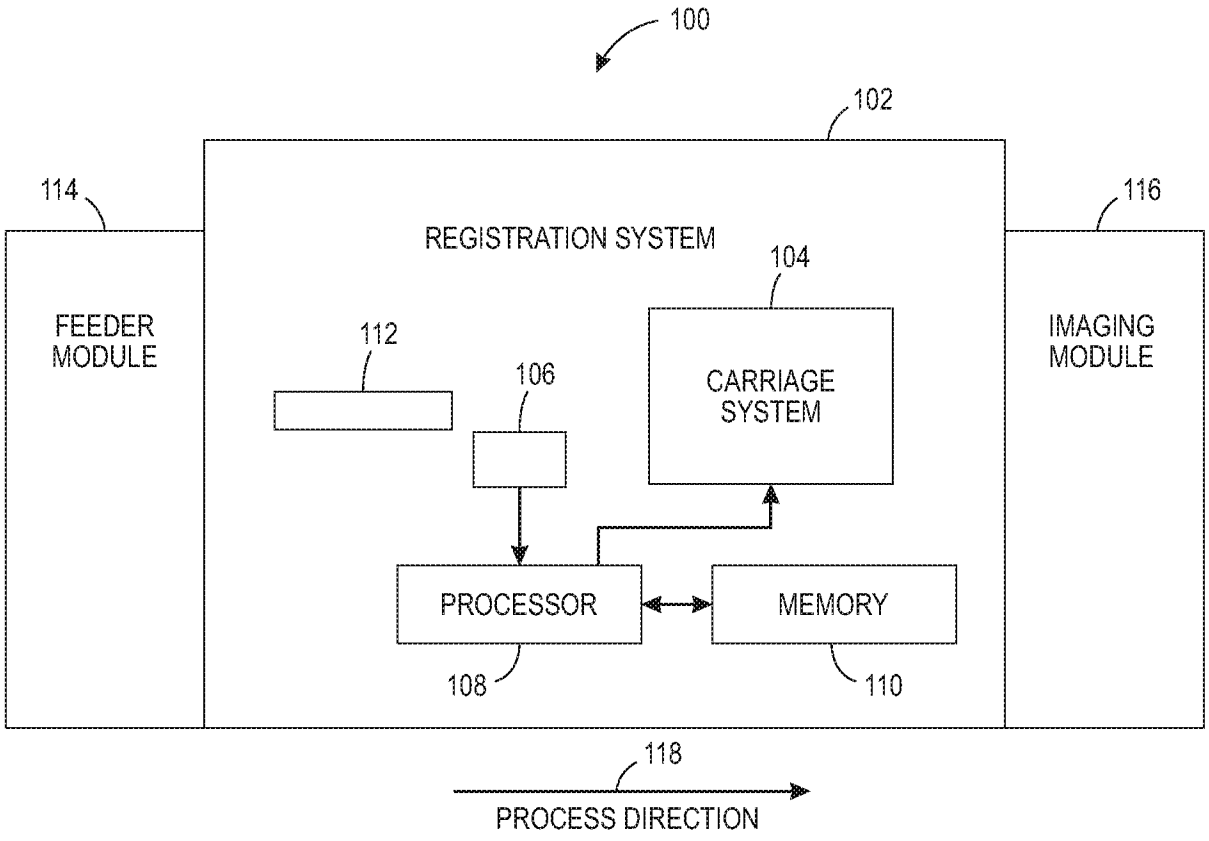
FIG. 1 illustrates a block diagram of an example printing device of the present disclosure.

FIG. 1 illustrates a block diagram of an example printing device 100 of the present disclosure. The printing device 100 may be any type of printing device such as a multi-function device (MFD), a copy machine, laser printer, an ink jet printer, and the like.

In one embodiment, the printing device 100 may include a feeder module 114, a registration system 102, and an imaging module 116. It should be noted that the printing device 100 has been simplified for ease of explanation. The printing device 100 may include additional components and modules that are not shown. For example, the printing device 100 may include a finishing module, print heads, a duplex paper path, a digital front end, a graphical user interface (GUI), and the like.

In one embodiment, the feeder module 114 may include feeder trays that feed a print media 112 through the printing device 100. The print media 112 may be any type of print media such as paper, card stock, and the like, and may have any dimensions. In one embodiment, the printing device 100 of the present disclosure may be designed to handle print media 112 with high aspect ratios or very long lengths (e.g., 40 inches or longer). The feeder module 114 may feed the print media 112 to the registration system 102.

In one embodiment, the registration system 102 may include a carriage system 104 of the present disclosure that uses a spline and yoke system as described below and illustrated in FIGS. 2-4. The registration system 102 may include at least one sensor 106. The registration system 102 may include additional transport nips, idler rollers, and platforms that are not shown.

In one embodiment, the sensor 106 may be located upstream from the carriage system 104. The sensor 106 may be any type of sensor that can detect a position of the print media 112. For example, the sensor 106 may be a charged coupled device (CCD) sensor, a contact image sensor (CIS), a capacitive sensor, a resistive sensor, an image based sensor, and the like.

The position detected by the sensor 106 may include a skew and a lateral position of the print media 112. The skew may measure an amount of tilt, or angle, in an inboard or an outboard direction relative to a line that is parallel to a process direction 118. In other words, zero skew may mean that both sides of the leading edge of the print media 112 would reach the sensor 106 simultaneously. If there is skew, one side (e.g., the left side) of the leading edge may reach the sensor 106 before the other side (e.g., the right side) of the leading edge reaches the sensor 106.

The lateral position may detect an amount a distance from a desired alignment position. For example, if the printing device 100 is a center registered device, then the lateral position may measure a distance that a center of the print media 112 is away from a center of the registration system 102. In another example, if the printing device 100 is an edge registered device, then the lateral position may measure a distance that an edge of the print media 112 is from a registration edge of the registration system 102.

In one embodiment, the registration system 102 may include a processor 108 and a memory 110. The processor 108 may be communicatively coupled to the carriage system 104, the sensor 106, and the memory 110. The position of the print media 112 detected by the sensor 106 may be transmitted to the processor 108. The processor 108 may then control the carriage system 104 (e.g., the motors that rotate a lead screw and control rotational speeds of the drive rollers, as discussed below) by a desired amount to adjust the position of the print media 112 into a correct position.

The registration system 102 may position the print media 112 properly such that the print media 112 is aligned with a desired image that is printed onto the print media 112. In other words, the registration system 102 may prevent printing errors where the desired image is angled, tilted, or off center on the print media 112 due to skew or lateral position errors.

In one embodiment, the memory 110 may be a non-transitory computer readable medium that may store instructions that are executed by the processor 108 to perform the adjustment or to control the carriage system 104 by the desired amount. The memory 110 may store data used by the processor 108 to perform the calculations to determine the desired amount of movement of the carriage system 104 and/or drive rollers. For example, the memory 110 may store conversion tables or values to calculate the desired lateral adjustments and/or desired skew adjustments. The conversion tables may have values that correlate lateral distance values to an amount of rotation of a lead screw or skew adjustment amounts to a rotational speed of each drive roller, and the like.

In one embodiment, the imaging module 116 may print a desired image onto the print media 112. The imaging module 116 may use any type of printing means to print the desired image. For example, the imaging module 116 may include an imaging belt that transfers toner that is dispensed onto the imaging belt onto the print media 112. In another example, the imaging module 116 may include ink jet print heads that print a desired image onto the print media 112, and the like.

Figure 2:
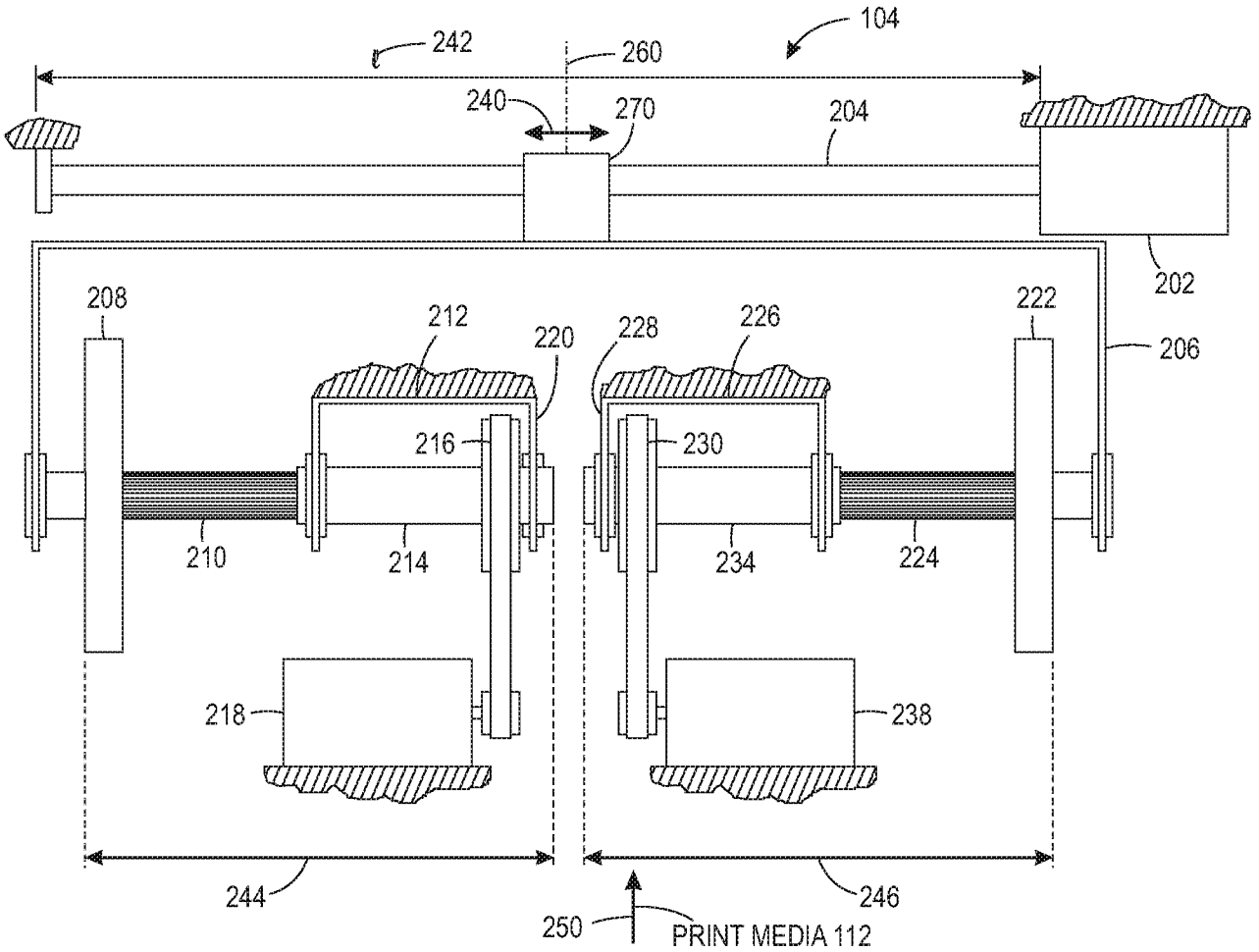
FIG. 2 illustrates a top view block diagram of an example registration system of the present disclosure.

FIG. 2 illustrates a top view of a block diagram of an example of the carriage system 104. In one example, the carriage system 104 may include a lead screw motor 202 coupled to a lead screw 204. A movable bracket 270 may be coupled to the lead screw 204. The movable bracket 270 may move left to right as shown by an arrow 240 in FIG. 2 as the lead screw 204 is rotated by the lead screw motor 202. Rotating the lead screw 204 in a first direction may cause the movable bracket 270 to move inboard. Rotating the lead screw 204 in a second direction that is opposite the first direction may cause the movable bracket 270 to move in an outboard direction. In one example, the movement left and right may be a movement along an inboard or an outboard direction within the registration system 102.

In one embodiment, a carriage 206 may be coupled to the movable bracket 270. The carriage 206 may move left and right in a direction as shown by the arrow 240 as the movable bracket 270 moves. In one example, the carriage 206 may use a spline and yoke system, as noted above and described in further details below. The yoke may be part of a fixed or immovable portion such that the carriage 206 has less weight to move, thereby reducing the overall load and weight on the lead screw motor 202. As noted above, the reduced weight may lower the amount of inertia to allow the lead screw motor 202 to more efficiently and accurately move the carriage 206.

In one embodiment, the carriage 206 may include a first drive roller 208 that is coupled to a first splined shaft 210 and a second drive roller 222 that is coupled to a second splined shaft 224. In one example, the carriage system 104 may include an immovable portion 212 and an immovable portion 226. The immovable portion 212 may include a bracket 220 that is coupled to a first yoke 214. The bracket 220 may be fixed to a non-moving physical structure (e.g., a wall, a portion of the housing, a fixed metal plate, or any other immovable portion) of the registration system 102.

In one embodiment, a first pulley 216 may be coupled to the first yoke 214. In one embodiment, the first yoke 214 may have a grooved portion that corresponds to the first pulley 216 to prevent the first pulley 216 from sliding or moving when being rotated. The first pulley 216 may be coupled to a first drive motor 218. In one embodiment, bearings may be used to couple the bracket 220 to the first yoke 214 to allow the first yoke to freely rotate as the first pulley 216 is rotated by the drive motor 218.

In one embodiment, the first splined shaft 210 may have a shaped outer circumference. For example, the first splined shaft 210 may have a star shaped outer circumference. In other words, the first splined shaft 210 may have ridges that run along a length of the first splined shaft 210. The first yoke 214 may have an inner volume or hollow portion with an inner circumference that has a shape that is approximately the same as the shape of the outer circumference of the first splined shaft 210. For example, the inner circumference of the inner volume of the first yoke 214 may also be star shaped. An example of the shaped outer circumference and the shaped inner circumference is shown in FIG. 4, and discussed in further details below.

As a result, the ridges of the first splined shaft 210 may engage the corresponding ridges of the first yoke 214. When, the first yoke 214 is rotated by the first drive motor 218 and the first pulley 216, the first yoke 214 may also rotate the first splined shaft 210 and the first driver roller 208.

In addition, the first splined shaft 210 may move into and out of the inner volume of the first yoke 214 as the carriage 206 is moved left and right by the lead screw 204 and the lead screw motor 202. However, the first yoke 214, the first pulley 216 and the first drive motor 218 may remain stationary when the carriage 206 is moved. In other words, the first yoke 214, the first pulley 216 and the first drive motor 218 do not move and are in a fixed position. In other words, the first yoke 214, the first pulley 216 and the first drive motor 218 are not moved by the carriage 206.

In one embodiment, the carriage 206 may also include a second drive roller 222 that is coupled to the second splined shaft 224. The second splined shaft 224 may be coupled to the immovable portion 226. The immovable portion 226 may include a second yoke 234, a second pulley 230, and a second drive motor 238. A bracket 228 may be coupled to the second yoke 234 (e.g., using bearings to allow the second yoke 234 to rotate) to prevent the immovable portion 226 from moving.

In one embodiment, the second splined shaft 224 and the second yoke 234 may shaped similar to the first splined shaft 210 and the first yoke 214. In other words, the second splined shaft 224 may also have a shaped outer circumference (e.g., ridges or a star shape) and the second yoke 234 may have an inner volume or a hollow portion that has a similarly shaped inner circumference.

The second splined shaft 224 may move into and out of the inner volume of the second yoke 234 similar to how the first splined shaft 210 and the first yoke 214 move when the carriage 206 is moved, as descried above. However, the second splined shaft 224 may move in a direction that is opposite the first splined shaft 210 relative to the respective first yoke 214 and second yoke 234. An example of the movement is illustrated in FIG. 3 and described below.

Figure 3:
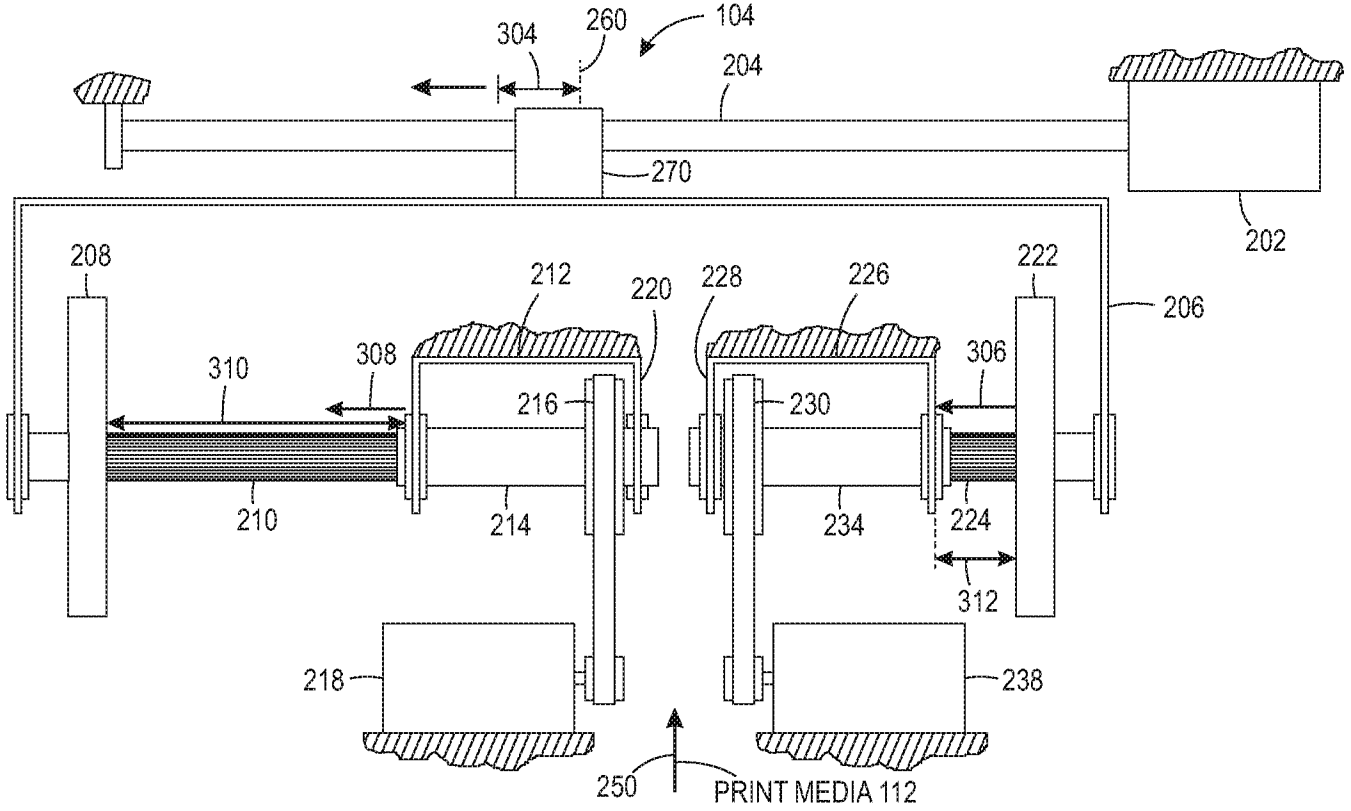
FIG. 3 illustrates a top view block diagram of an example movement of the registration system of the present disclosure.

FIG. 3 illustrates an example of the carriage 206 being moved to the left. For example, in FIG. 2, the movable bracket 270 begins in a center position 260. In FIG. 3, the movable bracket 270 is moved to the left by an amount shown by an arrow 304. For example, the lead screw 204 may be rotated by the lead screw motor 202 to move the movable bracket 270 and the carriage 206 to the left.

As noted above, the first splined shaft 210 and the second splined shaft 224 may move in opposite directions. For example, the first splined shaft 210 may move further out of the first yoke 214. Meanwhile, the second splined shaft 224 may move further into the second yoke 234. For example, the first splined shaft 210 may move an amount shown by an arrow 308. The second splined shaft 224 may move an amount shown by an arrow 306. The distance represented by the arrows 304, 306, and 308 may be equal to one another.

After the carriage 206 is moved, as shown in FIG. 3, a length 310 of the first splined shaft 210 that is visible may be longer than a length 312 of the second splined shaft 224 that is visible. As noted above, the different visible lengths may be caused by the first splined shaft 210 moving out of the first yoke 214 and the second splined shaft 224 moving further into the second yoke 234.

The lateral movement of the carriage 206 may be used to adjust a lateral position of the print media 112 that enters from the bottom of the page, as shown by an arrow 250. Thus, based on the detected position of the print media 112, the carriage 206 may be moved left or right to adjust the lateral position of the print media 112.

In one embodiment, the first drive motor 218 may control a rotational speed of the first drive roller 208. The second drive motor 238 may control a rotational speed of the second drive roller 222. The first drive motor 218 and the second drive motor 238 may be controlled independently of each other. In other words, the first drive roller 208 may be rotated at a different speed (e.g., slower or faster) than the second drive roller 222. Thus, the rotational speed of the first drive roller 208 and the second drive roller 222 may be independent of one another to adjust a skew of the print media 112.

In one embodiment, the processor 108 may be communicatively coupled to the lead screw motor 202, the first drive motor 218, and the second drive motor 238. The processor 108 may control operation of the lead screw motor 202, the first drive motor 218, and the second drive motor 238. For example, the processor 108 may determine a current position of the print media 112 entering the registration system 102 based on signals from the sensor 106. The processor 108 may calculate the desired lateral adjustment and control the lead screw motor 202 to move the carriage 206 a desired amount to make the lateral adjustment. The processor 108 may also calculate the desired skew adjustment and control the first drive motor 218 and the second drive motor 238 to move the first drive roller 208 and the second drive roller 222 at a desired rotational speed to make the desired skew adjustment.

Referring back to FIG. 2, the first splined shaft 210 and the first yoke 214 may have a length 244. The second splined shaft 224 and the second yoke 234 may have a length 246. The lead screw 204 may have a length 242. The combined length of 244 and 246 may be approximately equal to or slightly less than the length of 242 of the lead screw 204. The lengths 244 and 246 may allow the carriage 206 to be moved left or right along an entire length of the lead screw 204.

Figure 4:
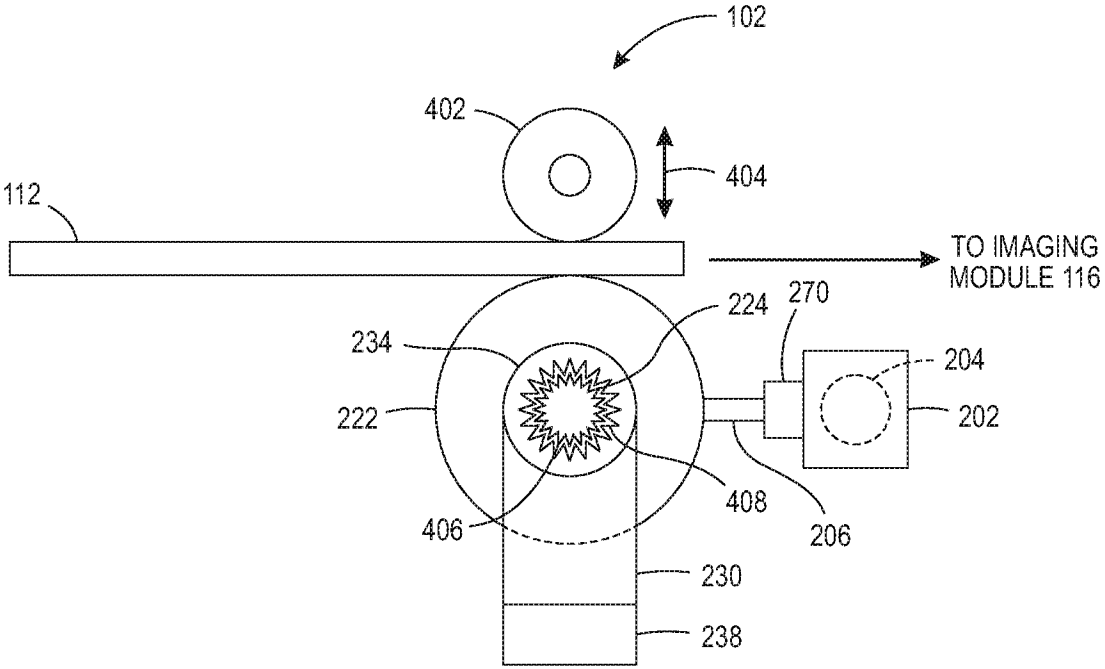
FIG. 4 illustrates a cross-sectional view of the registration system of the present disclosure.

FIG. 4 illustrates a block diagram of a cross-sectional view of the registration system 102. It should be noted that FIG. 4 has been simplified for ease of explanation and may include additional components that are not shown. For example, the registration system 102 may include additional hardware, brackets, housings, rollers, moving components, electrical components, and the like, that are not shown.

FIG. 4 illustrates how the second pulley 230 is coupled to the second yoke 234 and the second drive motor 238. FIG. 4 illustrates the interior volume of the second yoke 234 and how the second splined shaft 224 is inserted into the interior volume of the second yoke 234. As noted above, the outer circumference 406 of the second splined shaft 224 (as well as the first splined shaft 210) may have a shape. FIG. 4 illustrates an example shape of a star. However, it should be noted that the shape may be any shape that includes raised ridges or portions that run along a length of the second splined shaft 224.

In addition, the second yoke 234 has an inner circumference 408 that also has a shape. The shape of the inner circumference 408 is shown to also be a star shape similar to the shape of the outer circumference 406 of the second splined shaft 224. However, it should be noted that the second yoke 234 may also have any shape for the inner circumference 408 as long as the shape is similar to the shape of the outer circumference 406 of the second splined shaft 224.

Using the star shape as an example, the raised ridges of the outer circumference 406 may engage the corresponding cut-out ridges of the inner circumference 408. As a result, when the second yoke 234 is rotated, the ridges may be engaged and cause the second splined shaft 224 to also rotate. The rotation of the second yoke 234 and the second splined shaft 224 may cause the drive roller 222 to be rotated. In addition as the carriage 206 is moved laterally by the lead screw motor 202, the second splined shaft 224 may move into or out of (e.g., into the page or out of the page in the view illustrated in FIG. 4) the second yoke 234.

In one embodiment, the registration system 102 may also include an idler roller 402 that may be movable vertically as shown by an arrow 404. The idler roller 402 may be moved down when the print media 112 enters the registration system 102. When the print media 112 exits towards the imaging module 116, the idler roller 402 may be moved back up to prepare to receive the next print media 112.

It should be noted that the spline and yoke system of the current disclosure also provides advantages over a gear system. For example, some registration systems may use a gear system that uses external gears. However, the gear systems may have gear mesh issues and more rotational inertia than the spline and yoke system of the present disclosure.

Figure 5:
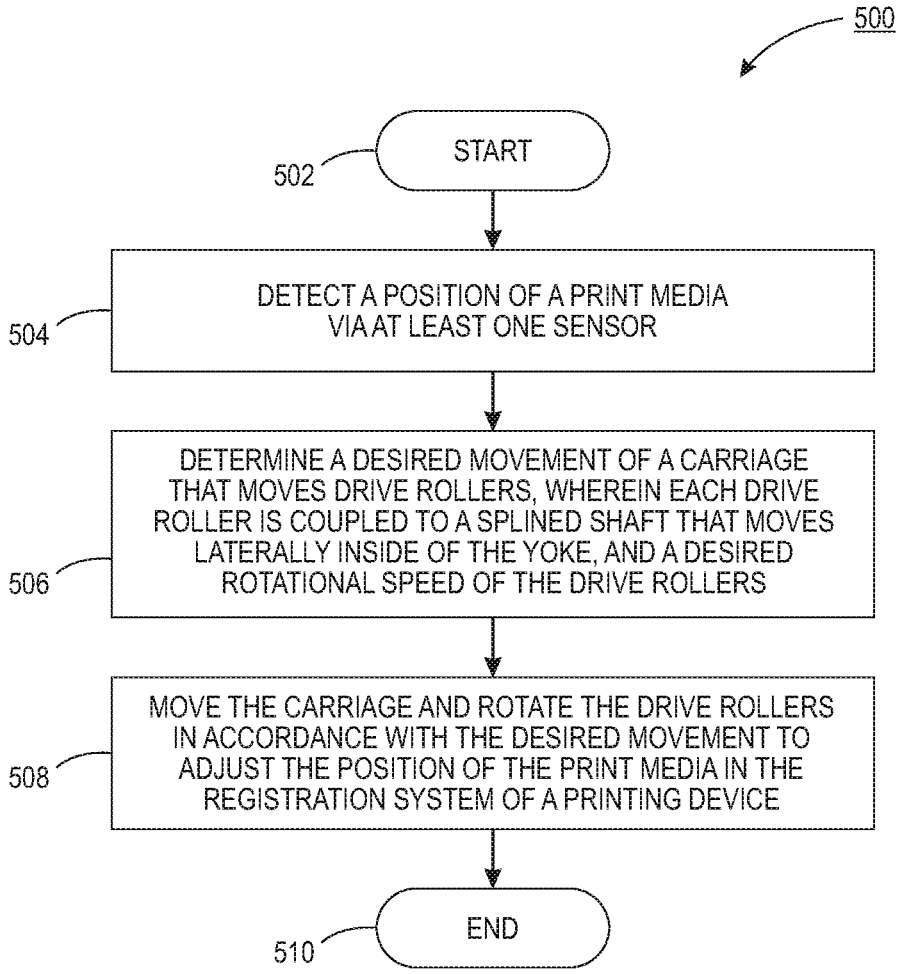
FIG. 5 illustrates a flowchart of an example method for controlling a position of a print media in a registration system of the present disclosure.
Figure 6:
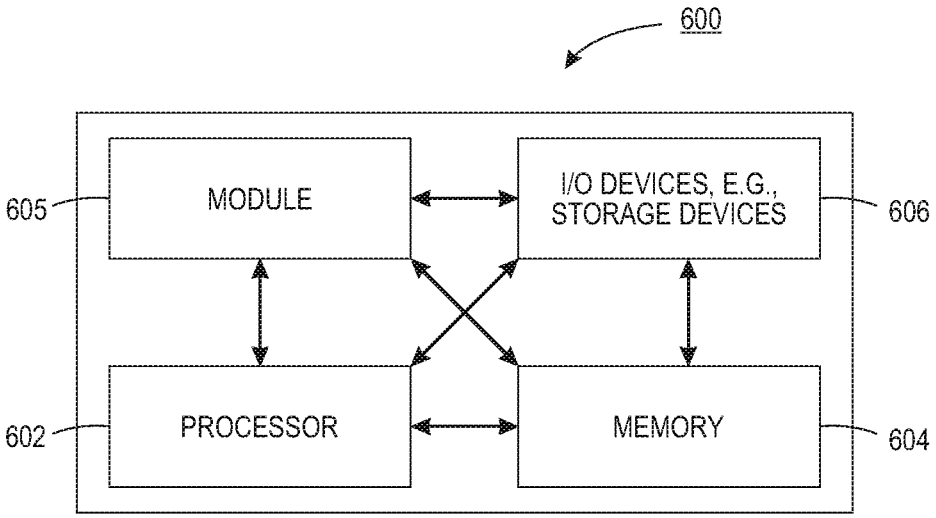
FIG. 6 illustrates a high-level block diagram of an example computer suitable for use in performing the functions described herein.

FIG. 5 illustrates a flowchart of an example method 500 for controlling a position of a print media in a registration system. In one embodiment, one or more steps or operations of the method 500 may be performed by the registration system 102, or a computer/processor that controls operation of the registration system 102 as illustrated in FIG. 6 and discussed below.

At block 502, the method 500 begins. At block 504, the method 500 detects a position of the print media via at least one sensor. In one embodiment, the print media may be any type of paper.

The skew may be an angle that the print media is tilted off of a straight line in the process direction. The lateral position may measure an amount that the print media is laterally away from a desired alignment position. For example, for a center registered system, the lateral position may include an amount and a direction (e.g., inboard or outboard) that the print media is off-center. For an edge registered system, the lateral position may include an amount of lateral movement away from the alignment edge.

At block 506, the method 500 determines a desired movement of a carriage that moves drive rollers, wherein each drive roller is coupled to a splined shaft and a yoke, wherein the splined shaft moves laterally inside of the yoke, and a desired rotational speed of the drive rollers. In one embodiment, an amount of lateral adjustment may be determined based on the signals from the sensor indicating the position of the print media. The lateral movement of the carriage may correct the position of the print media by the desired amount of lateral adjustment. The amount of rotation of the lead screw by the lead screw motor may be correlated to the desired lateral adjustment.

In one embodiment, the skew adjustment may also be determined based on signals from the sensor indicating the position of the print media. The rotational speed of the drive rollers may be determined based on the desired amount of skew adjustment.

At block 508, the method 500 moves the carriage and rotates the drive rollers in accordance with the desired movement to adjust the position of the print media in the registration system of a printing device. In one embodiment, the carriage may be moved by rotating the lead screw by an amount calculated in block 506. The carriage may be moved such that only the drive rollers and the splined shafts are moved by the carriage. As noted above, the carriage may include immovable portions that include a yoke, a pulley, and a drive motor that are fixed to the registration system by a bracket. As a result, much of the weight is removed from the carriage to allow for more efficient and smoother movement and control of the carriage. The lateral movement of the carriage allows the splined shafts on opposite ends of the carriage to move into or out of the respective yokes in the respective immovable portions.

The drive rollers may be rotated by rotating the attached splined shafts by the respective yoke, pulley, and drive motor. The drive motors may rotate the respective yokes by the calculated rotational speed that is determined in block 506.

In one embodiment, the blocks 504, 506, and 508 may be repeated for each print media 112 that is fed through the registration system 102. At block 510, the method 500 ends.

It should be noted that the blocks in FIG. 5 that recite a determining operation or involve a decision do not necessarily require that both branches of the determining operation be practiced. In other words, one of the branches of the determining operation can be deemed as an optional step. In addition, one or more steps, blocks, functions or operations of the above described method 500 may comprise optional steps, or can be combined, separated, and/or performed in a different order from that described above, without departing from the example embodiments of the present disclosure.

FIG. 6 depicts a high-level block diagram of a computer that is dedicated to perform the functions described herein. As depicted in FIG. 6, the computer 600 comprises one or more hardware processor elements 602 (e.g., a central processing unit (CPU), a microprocessor, or a multi-core processor), a memory 604, e.g., random access memory (RAM) and/or read only memory (ROM), a module 605 for controlling a position of a print media in a registration system, and various input/output devices 606 (e.g., storage devices, including but not limited to, a tape drive, a floppy drive, a hard disk drive or a compact disk drive, a receiver, a transmitter, a speaker, a display, a speech synthesizer, an output port, an input port and a user input device (such as a keyboard, a keypad, a mouse, a microphone and the like)). Although only one processor element is shown, it should be noted that the computer may employ a plurality of processor elements.

It should be noted that the present disclosure can be implemented in software and/or in a combination of software and hardware deployed on a hardware device, a computer or any other hardware equivalents (e.g., the registration system 102). For example, computer readable instructions pertaining to the method(s) discussed above can be used to configure a hardware processor to perform the steps, functions and/or operations of the above disclosed methods. In one embodiment, instructions and data for the present module or process 605 for controlling a position of a print media in a registration system (e.g., a software program comprising computer-executable instructions) can be loaded into memory 604 and executed by hardware processor element 602 to implement the steps, functions or operations as discussed above in connection with the example method 500. Furthermore, when a hardware processor executes instructions to perform "operations," this could include the hardware processor performing the operations directly and/or facilitating, directing, or cooperating with another hardware device or component (e.g., a co-processor and the like) to perform the operations.

The processor executing the computer readable or software instructions relating to the above described method(s) can be perceived as a programmed processor or a specialized processor. As such, the present module 605 for controlling a position of a print media in a registration system (including associated data structures) of the present disclosure can be stored on a tangible or physical (broadly non-transitory) computer-readable storage device or medium, e.g., volatile memory, non-volatile memory, ROM memory, RAM memory, magnetic or optical drive, device or diskette and the like. More specifically, the computer-readable storage device may comprise any physical devices that provide the ability to store information such as data and/or instructions to be accessed by a processor or a computing device such as a computer or an application server.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. A registration system for a printing device, comprising:
a lead screw motor;
a lead screw coupled to the lead screw motor; and
a carriage coupled to the lead screw, the carriage comprising:
two drive rollers, wherein each drive roller is coupled to a respective splined shaft coupled to a respective yoke, wherein the respective yoke is coupled to a drive pulley and a drive motor that is in a fixed position, wherein movement of the carriage causes the respective splined shaft of the two drive rollers to move guided by the respective yoke.

2. The registration system of claim 1, wherein the respective splined shaft comprises a shaped outer circumference and the respective yoke comprises an internal circumference having a shape that corresponds to the shape of the outer circumference of the respective splined shaft.

3. The registration system of claim 2, wherein the shaped outer circumference comprises raised ridges that run along a length of the respective splined shaft.

4. The registration system of claim 3, wherein a combined length of the respective splined shaft and the respective yoke of the two drive rollers is approximately equal to a length of the lead screw.

5. The registration system of claim 1, wherein the drive motor causes the drive pulley to rotate the respective yoke, which causes the respective splined shaft to rotate each drive roller.

6. The registration system of claim 1, wherein the respective yoke guides movement of the respective splined shaft along a length into or out of a hollow volume of the respective yoke.

7. The registration system of claim 1, wherein movement of the carriage is controlled by rotation of the lead screw by the lead screw motor.

8. The registration system of claim 1, further comprising:
a sensor to detect a position of a print media entering the registration system.

9. The registration system of claim 8, further comprising:
a processor communicatively coupled to the sensor, the lead screw motor, and the drive motor, wherein the processor calculates a desired movement of the carriage and a rotational speed of the two drive rollers based on the position of the print media.

10. The registration system of claim 9, wherein movement of the carriage is to adjust a lateral position of the print media.

11. The registration system of claim 9, wherein the rotational speed of the two drive rollers is to adjust a skew of the print media.

12. The registration system of claim 2, wherein the shaped outer circumference comprises a star shaped outer diameter and the and the shape of the internal circumference comprises a star shaped inner diameter.

* * * * *